US007530242B2

(12) United States Patent
Lonati et al.

(10) Patent No.: US 7,530,242 B2
(45) Date of Patent: May 12, 2009

(54) METHOD FOR TRANSFERRING PORTIONS OF KNITTING PRODUCED BY A GROUP OF NEEDLES TO ANOTHER GROUP OF NEEDLES OF A BED, IN CIRCULAR HOSIERY KNITTING MACHINES WITH TWO BEDS OR THE LIKE

(75) Inventors: Tiberio Lonati, Brescia (IT); Fausto Lonati, Brescia (IT); Ettore Lonati, Botticino (IT)

(73) Assignee: Santoni S.p.A., Brescia (IT)

( * ) Notice: Subject to any disclaimer, the term of this patent is extended or adjusted under 35 U.S.C. 154(b) by 51 days.

(21) Appl. No.: 11/791,852

(22) PCT Filed: Dec. 12, 2005

(86) PCT No.: PCT/EP2005/013318

§ 371 (c)(1),
(2), (4) Date: May 30, 2007

(87) PCT Pub. No.: WO2006/066750

PCT Pub. Date: Jun. 29, 2006

(65) Prior Publication Data

US 2008/0047304 A1 Feb. 28, 2008

(30) Foreign Application Priority Data

Dec. 23, 2004 (IT) ..... MI2004A2495

(51) Int. Cl.
*D04B 15/02* (2006.01)

(52) U.S. Cl. ..... 66/148

(58) Field of Classification Search ..... 66/147, 66/148, 149 R, 150, 152
See application file for complete search history.

(56) References Cited

U.S. PATENT DOCUMENTS

| | | | | |
|---|---|---|---|---|
| 3,340,706 | A | 9/1967 | Currier | |
| 3,626,726 | A * | 12/1971 | Findley et al. | 66/15 |
| 3,685,321 | A | 8/1972 | Millar | |
| 3,768,277 | A * | 10/1973 | Uhlir | 66/9 R |
| 4,047,401 | A | 9/1977 | Nurk et al. | |
| 5,647,229 | A * | 7/1997 | Conti | 66/58 |
| 5,924,310 | A * | 7/1999 | Conti | 66/58 |
| 5,966,968 | A | 10/1999 | Lonati et al. | |
| 6,381,991 | B2 * | 5/2002 | Ando' | 66/58 |

FOREIGN PATENT DOCUMENTS

GB 2 187 765 A 9/1987

* cited by examiner

*Primary Examiner*—Danny Worrell
(74) *Attorney, Agent, or Firm*—Modiano & Associati; Albert Josif; Daniel J. O'Byrne

(57) ABSTRACT

A method for transferring a portion of knitting produced by a group of needles to another group of needles of a bed in circular hosiery knitting machines with two beds comprising a step, performed by engagement elements arranged in a first sector of the second bed, for engaging a row of knitting formed by the needles arranged in a first sector of the first bed and a step for angular offset of the second bed with respect to the first bed, in order to move the first sector of the second bed closer to a second sector of the first bed; a step for releasing the row of knitting previously engaged by the engagement elements, to the needles arranged in the second sector of the first bed and, during the engagement release step, a reversal of the orientation of the row of knitting affected by the transfer.

5 Claims, 10 Drawing Sheets

METHOD FOR TRANSFERRING PORTIONS OF KNITTING PRODUCED BY A GROUP OF NEEDLES TO ANOTHER GROUP OF NEEDLES OF A BED, IN CIRCULAR HOSIERY KNITTING MACHINES WITH TWO BEDS OR THE LIKE

The present invention relates to a method for transferring portions of knitting produced by a group of needles to another group of needles of a bed in circular hosiery knitting machines with two beds or the like, in which the two beds are coaxial and face each other. The method according to the invention can be used in particular to join portions of knitting produced by at least two groups of needles arranged in two sectors of a same bed, constituted for example by the needle cylinder of a cylinder-and-dial machine, which are mutually angularly spaced around the axis of the bed, on the same machine used to produce them.

BACKGROUND OF THE INVENTION

Circular hosiery knitting machines are known which have two coaxial and mutually facing beds and are constituted for example by a needle cylinder, which has a vertical axis, and by a dial, which is arranged above and coaxially with respect to the needle cylinder.

A plurality of axial slots are provided on the lateral surface of the needle cylinder, and each slot accommodates a needle which can be actuated with a reciprocating motion along the corresponding axial slot in order to produce knitting.

In the dial of these machines a plurality of radial slots are provided, each of which accommodates at least one engagement element, which can be constituted by a hook or by a pusher or by a needle, which can move on command along the corresponding radial slot in order to pass from an extracted position, in which it protrudes from the peripheral profile of the dial, to a retracted position, in which it is recessed within the dial in order to avoid interfering with the needles of the needle cylinder.

In the extracted position, the engagement elements can interact with at least one needle of the needle cylinder in order to engage a loop of knitting or more generally a portion of a row of knitting produced by the needles of the needle cylinder or in order to release a loop of knitting or a portion of a row of knitting engaged previously to a needle of the needle cylinder.

In the retracted position, the engagement elements can retain the loop of knitting or portion of row engaged previously without interfering with the needles of the needle cylinder.

Depending on the type of engagement elements used, the engagement elements can pick up loops of knitting, in the strict sense of the term, from the needles that have produced them or can retain portions of loop linking yarn during the formation of a row of knitting by the needles of the needle cylinder and then release to the needles of the needle cylinder the loops of knitting previously picked up or the portions of loop linking yarn previously retained. For the sake of simplicity in presentation, the expression "loop of knitting" is understood hereinafter to designate a portion of a row of knitting which can be constituted by a loop of knitting in the strict sense of the term or by a portion of loop linking yarn.

In some machines, each engagement element is constituted by two or more elements arranged side-by-side, which are generally arranged in a same radial slot of the dial and cooperate with each other and with the needles of the needle cylinder in order to pick up loops of knitting from the needles of the needle cylinder or release to the needles of the needle cylinder loops of knitting previously picked up by other needles of the needle cylinder or retained during the formation of a row of knitting on the part of the needles of the needle cylinder.

If the engagement elements arranged in the dial are constituted by needles, said needles, in addition to being usable to engage or pick up loops of knitting produced by the needles of the needle cylinder, can also be used to produce knitting.

In the field of the production of items of clothing known as "seamless", i.e., items of clothing which have a tubular structure without seams at their lateral regions, the need is felt to be able to join portions of knitting, produced by groups of needles which are arranged in the needle cylinder and are mutually angularly spaced around the axis of the needle cylinder, so as to avoid the need to subsequently rework the item of clothing in order to produce the seam for joining said portions of knitting.

A need of this kind occurs for example for the shoulder straps of vests, bras, body suits or for the crotch of underpants.

SUMMARY OF THE INVENTION

The aim of the present invention is to provide a method which allows to transfer portions of knitting produced by a group of needles to another group of needles of a bed in circular hosiery knitting machines with two beds or the like, maintaining or varying the orientation of the portion of knitting that is transferred so as to allow to perform, directly on the machine used to produce an article, the joining of portions of knitting produced by groups of needles located in sectors of a bed which are mutually angularly spaced around the axis of the bed or, more generally, to provide particular knitting processes which require the transfer of portions of knitting from the needles that produced them to other needles of a bed.

Within this aim, an object of the invention is to provide a method which, by allowing to vary or maintain the orientation of portions of knitting before they are joined to other portions of knitting, allows to obtain, if required, particular aesthetic effects on the item of clothing without requiring subsequent sewing operations.

Another object of the invention is to provide a method which allows to reduce the production costs of said items of clothing by avoiding the sewing operation for joining portions of knitting.

Another object of the invention is to provide a method which allows to produce more comfortable items of clothing by avoiding the use of stitched seams to join portions of items of clothing.

This aim and these and other objects, which will become better apparent hereinafter, are achieved by a method for transferring portions of knitting produced by a group of needles to another group of needles of a bed in circular hosiery knitting machines with two beds or the like, which comprise two mutually coaxial and facing beds, respectively a first bed provided with needles which can be actuated to produce knitting and a second bed provided with engagement elements, which can be actuated in order to retain or pick up loops of knitting formed by the needles of the first bed or to release loops of knitting, retained or picked up previously, to the needles of the first bed, characterized in that it comprises:

- a step, performed by means of the engagement elements arranged in a first sector of the second bed, for engaging a row of knitting formed by a first group of needles arranged in a first sector of the first bed;
- a step for the angular offset of the second bed with respect to the first bed around the axis of the first bed, in order to move said first sector of the second bed closer to a second sector of the first bed which is angularly spaced from said first sector of the first bed around the axis of the first bed and supports a second group of needles;

a step for releasing the row of knitting previously engaged by said engagement elements from the engagement elements arranged in said first sector of the second bed to said second group of needles arranged in said second sector of the first bed; and reversing the orientation of the row of knitting affected by the transfer during said engagement step or during said release step.

The method according to the invention is meant to be performed preferably with a circular hosiery knitting machine of the type which comprises a needle cylinder which has a vertical axis and a dial which is arranged above and coaxially with respect to the needle cylinder and is provided with engagement elements which can be actuated in order to retain or pick up loops of knitting formed by the needles of the needle cylinder. If said engagement elements are constituted by hooks or pushers, i.e., elements which are not capable of forming knitting, the expression "first bed" is to be referred exclusively to the needle cylinder and the expression "second bed" is to be referred exclusively to the dial. If instead the engagement elements of the dial are constituted by needles, i.e., elements which can be actuated in order to form knitting, the expression "first bed" can be referred again to the needle cylinder and the expression "second bed" can be referred again to the dial or, equally, the expression "first bed" can be referred to the dial and the expression "second bed" can be referred to the needle cylinder. In this last case, the needles of the needle cylinder constitute the engagement elements of the second bed.

Without altering what has been specified above, for the sake of simplicity in description and greater clarity, the method according to the invention is described hereinafter by assuming that the "first bed" is the needle cylinder and the "second bed" is the dial of a circular hosiery knitting machine of the type with a needle cylinder and a dial.

BRIEF DESCRIPTION OF THE DRAWINGS

Further characteristics and advantages of the invention will become better apparent from the description of a preferred but not exclusive embodiment of the method according to the invention, illustrated by way of non-limiting example in the accompanying drawings, wherein.

DESCRIPTION OF THE PREFERRED EMBODIMENTS

Figure 1:
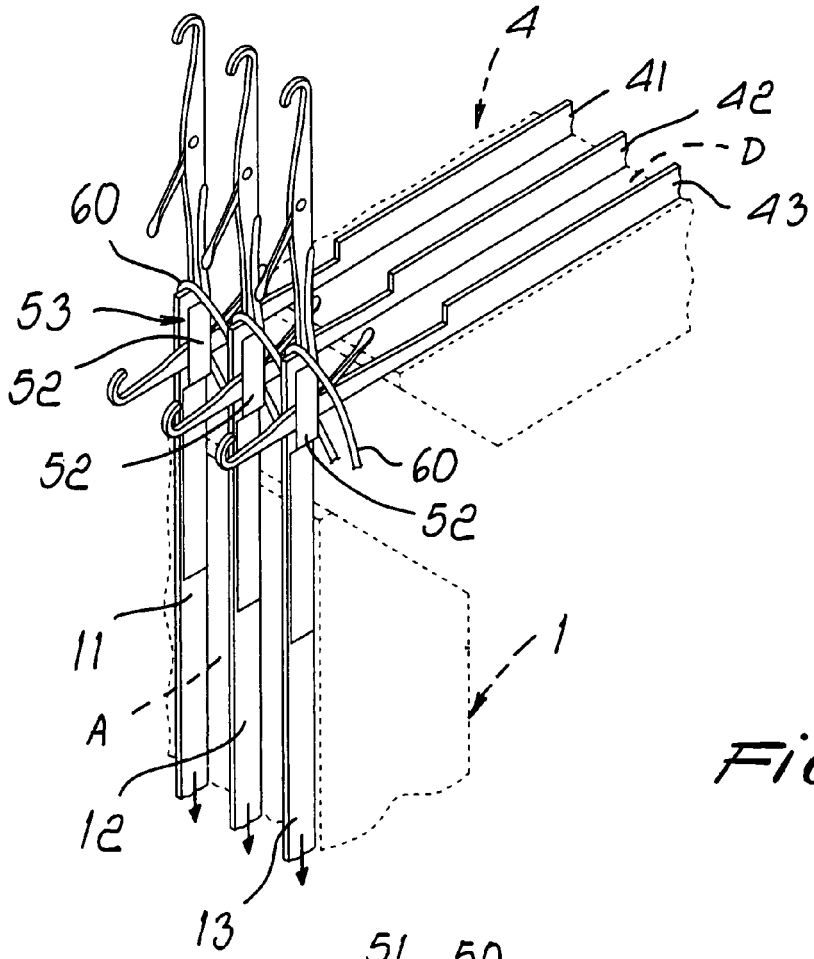
FIGS. 1 to 8 are schematic perspective views of the transfer of loops of knitting from one sector of the needle cylinder to another sector of the needle cylinder by means of the engagement elements arranged in a sector of the dial.

The method according to the invention is meant to be performed preferably with a circular hosiery knitting machine provided with a needle cylinder 1, which has a vertical axis 1*a*, and with a dial 4, which faces upwardly and coaxially the needle cylinder 1; said needle cylinder and said dial can each be actuated by means of a corresponding electric motor M1,M2, with the possibility to manage electronically, by way of an electronic control system ECS, the way in which the two electric motors are actuated so as to turn, in some steps of the operation of the machine, the dial 4 rigidly or jointly with respect to the needle cylinder 1 about the common axis 1*a* and turn, in other steps of the operation of the machine, the dial 4 with respect to the needle cylinder 1 through angles which can vary according to the different operating requirements.

The dial 4 of the machine is provided with engagement elements, which can be actuated in order to engage loops of knitting 60 of a row of knitting produced by the needles of the needle cylinder 1 or in order to release loops of knitting 60, previously engaged, to needles of the needle cylinder 1.

Each engagement element can be constituted, in a per se known manner, by a needle or by at least one pusher or by at least one hook.

Depending on the type of machine and on the operating requirements, if the engagement elements are constituted by pushers or hooks, each engagement element can comprise two or more elements arranged side-by-side, which cooperate with each other in order to engage the loop of knitting 60 to be transferred and then transfer it to a needle of the needle cylinder 1.

More particularly, in the dial 4 there is a plurality of radial slots, which are omitted in the figures for the sake of simplicity and inside each of which there is an engagement element, which can move on command along the corresponding radial slot in order to pass from an extracted position, in which it protrudes from the peripheral profile of the dial 4 in order to interact with at least one needle of the needle cylinder 1, engaging a loop of knitting 60 of a row of knitting formed by the needles of the needle cylinder 1 or releasing a loop of knitting 60 engaged previously to a needle of the needle cylinder 1, to a retracted position, in which it is retracted within the dial 4 so as to retain the loop of knitting 60 engaged previously and/or not interfere with the needles of the needle cylinder 1.

The movement of the engagement elements along the corresponding radial slots of the dial 4 in order to transfer them from the extracted position to the retracted position or vice versa is achieved by providing, in a per se known manner, the engagement elements with one or more heels which protrude upwardly from the dial 4 and can engage actuation cams, which face upwardly the dial 4 and with respect to which the dial 4 turns, like the needle cylinder 1, about its own axis 1*a* during the operation of the machine.

The dial 4, particularly when the engagement elements are constituted by needles, can be provided with selection devices which allow to select even individually which engagement elements must be moved from the retracted position to the extracted position or vice versa. One of these devices is disclosed for example in U.S. Pat. No. 6,014,875 by the same Applicant.

If the engagement elements are constituted by needles, as shown in FIGS. 1 to 8, said needles have, in a per se known manner, a lateral spring 50, which forms, on the side of the shank of the needle, in a region which is spaced from the region where the needle latch acts, a slot 51, astride which it is possible to arrange the loop of knitting 60 that must be transferred and into which the tip of the needle of the needle cylinder 1 that must receive said loop of knitting 60 can be inserted. The needles of the needle cylinder 1, if they can release loops of knitting 60 to the needles of the dial 4, are provided likewise with a lateral spring 52, which defines, on the side of the shank of the needle, in a region which is spaced from the region where the latch of the needle acts, a slot 53, astride which it is possible to arrange the loop of knitting 60 that must be transferred and in which the tip of the needle of the dial 4 that must receive said loop of knitting 60 can be inserted.

For the sake of simplicity in description, the method according to the invention is described hereinafter in its execution with engagement elements constituted by needles, without altering the fact that the method can be performed also with engagement elements constituted by pushers or hooks or other engagement elements of a known type.

The description that follows considers a first group of needles, constituted by three needles 11, 12, 13 arranged in a first sector A of the needle cylinder 1; a first group of engagement elements, constituted by three needles 41, 42, 43 arranged in a first sector D of the dial 4, and a second group of needles, constituted by three needles 14, 15, 16 arranged in a second sector B of the needle cylinder 1, but the number of needles and of engagement elements of the various groups may vary according to the requirements.

The method according to the invention comprises an engagement step, which is performed by means of the needles 41, 42, 43 arranged in the first sector D of the dial 4 of the machine, for engaging loops of knitting 60 of a row of knitting formed by a first group of needles 11, 12, 13 arranged in the first sector A of the needle cylinder 1.

This engagement step can be performed by picking up the loops of knitting 60 from the needles 11, 12, 13 by means of the needles 41, 42, 43 of the dial 4, for example at the end of the formation of a portion of knitting on the part of the needles 11, 12, 13 of the needle cylinder 1. In this case, the needles 11, 12, 13, at the end of the formation of said portion of knitting, are lifted toward the dial 4, so as to arrange the last loop of knitting 60 formed by each needle at the slot 53 formed on their side by the corresponding elastic spring 52 and arrange said slot 53 in alignment with the corresponding needle of the dial 4 which must pick up the loop of knitting 60. Subsequently, the needles of the dial 4, which were previously in the retracted position, are moved to the extracted position so as to enter the slot 53 of the corresponding needle of the needle cylinder 1 (FIG. 1), which is then lowered so as to leave the loop of knitting 60 on the needle of the dial 4.

As an alternative, the engagement step can be performed also at the beginning of the formation of a portion of knitting formed by the needles 11, 12, 13 of the needle cylinder 1 or in an intermediate step of the forming of the portion of knitting, moving the needles 41, 42, 43 of the dial 4 into the extracted position so that the yarn fed to the needles 11, 12, 13 of the needle cylinder 1 is engaged also by the needles 41, 42, 43 of the dial 4, which are then returned to the retracted position so as to retain the previously engaged yarn while the needles 11, 12, 13 of the needle cylinder 1 proceed with the formation of the portion of knitting.

Figure 2:
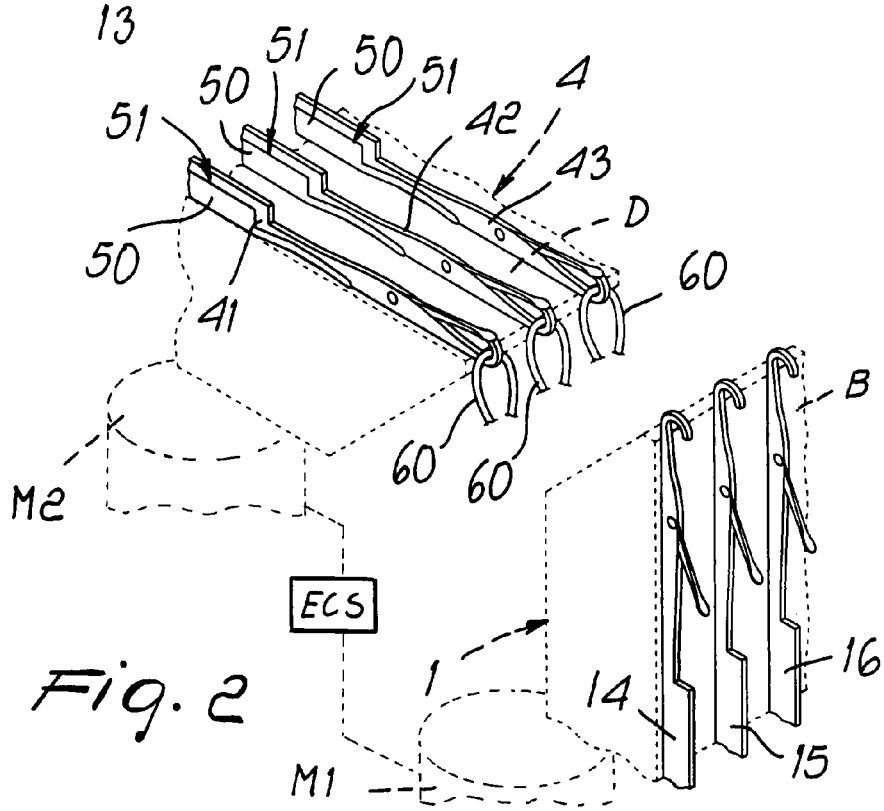

The dial 4 is then turned about its axis 1*a* with respect to the needle cylinder 1 through a preset offset angle, which moves the first sector D of the dial 4 with the needles 41, 42, 43 toward the second sector B of the needle cylinder 1 which supports the needles 14, 15, 16 and is angularly spaced from the first sector A around the axis 1*a* of the needle cylinder 1 (FIG. 2).

The loops of knitting 60 carried by the needles 41, 42, 43 of the dial 4 are then released to the needles 14, 15, 16 of the second sector B of the needle cylinder 1 (FIGS. 3-8).

According to the invention, the orientation of the row of knitting affected by the transfer is reversed during the engagement step or during the release step.

In the embodiment of the method shown in FIGS. 1 to 8, the reversal of the orientation of the row of knitting that is transferred is performed during the release step. More particularly, the release step is begun after arranging, by means of the offset of the dial 4 with respect to the needle cylinder 1, the angularly mutually closest or furthest ends of the first sector D of the dial 4 and of the second sector B of the needle cylinder 1 so that they face each other, as shown in FIG. 2, and is performed by passing, in each instance, a loop of knitting 60 from a needle of the dial 4 to a needle of the second group of needles of the needle cylinder 1, gradually increasing or decreasing, between the passage of a loop of knitting 60 and the passage of the contiguous loop of knitting 60, the angular offset of the dial 4 with respect to the needle cylinder 1 until the transfer of the row of knitting from the needles of the sector D of the dial 4 to the needles of the second group of needles of the needle cylinder 1 is completed, as shown in sequence in FIGS. 3 to 8.

The expression "the ends of the sectors" of the needle cylinder 1 and of the dial 4 respectively is used to designate the ends of the sectors that are occupied by needles involved in the transfer of the loops of knitting 60.

Figure 3:
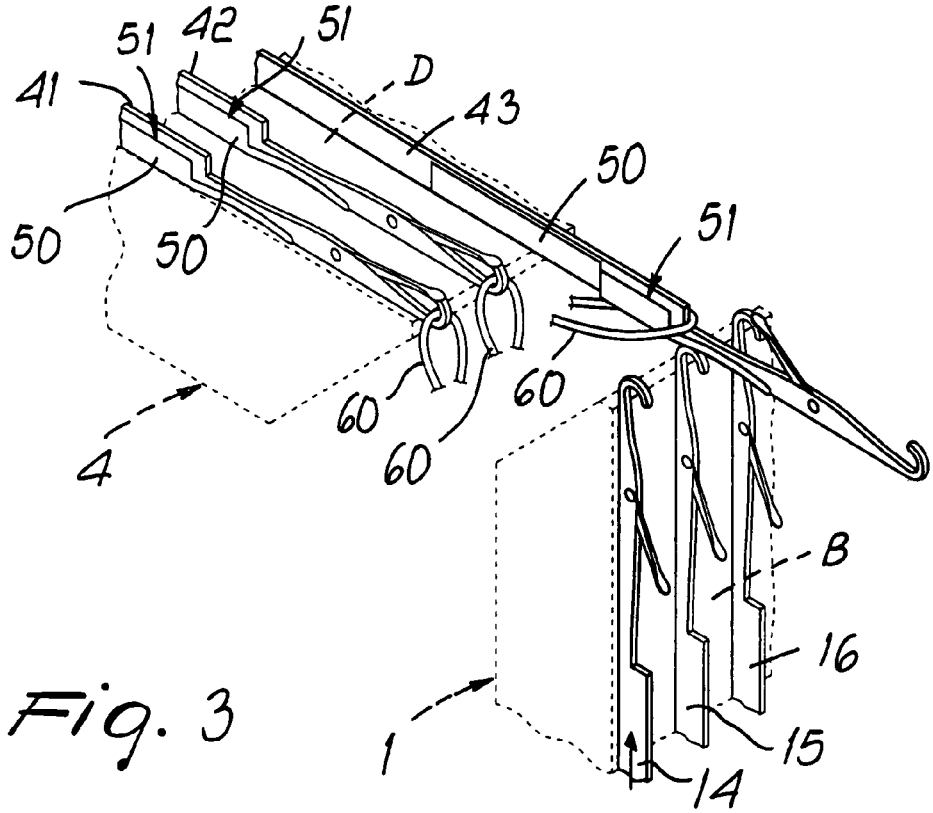
Figure 4:
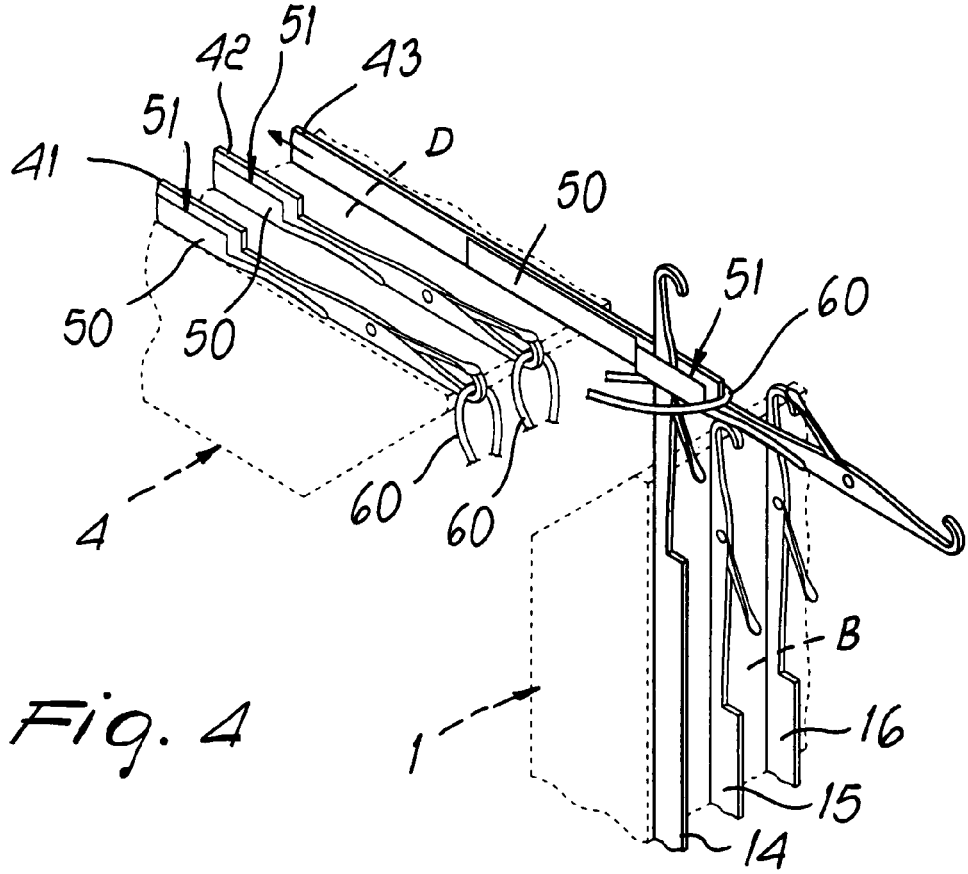
Figure 5:
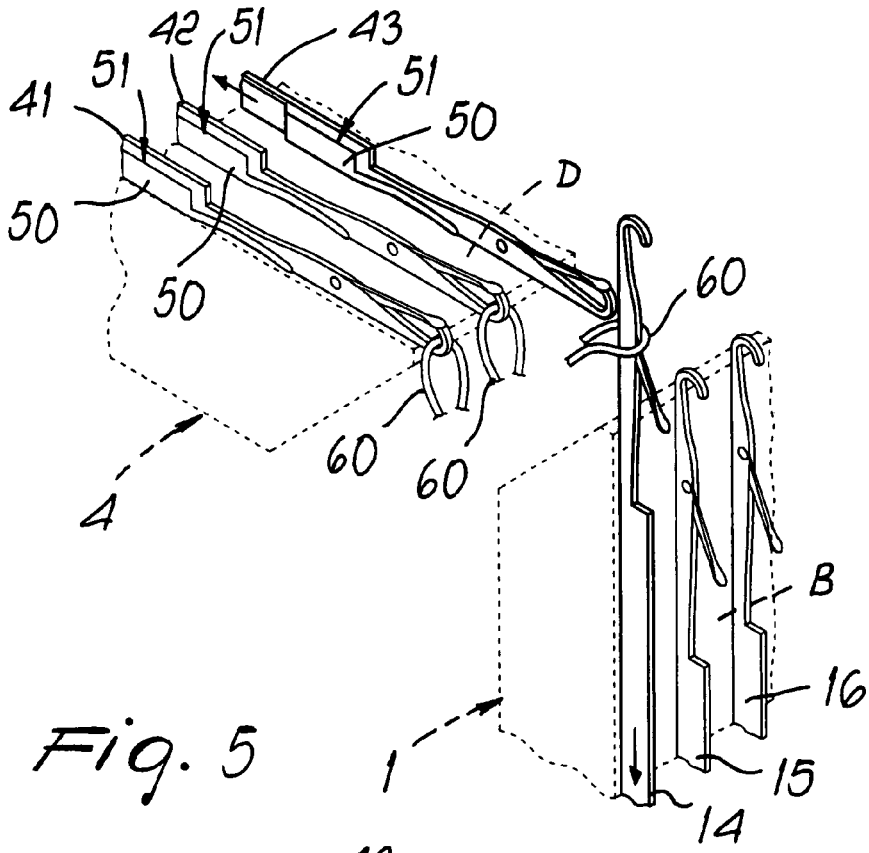
Figure 6:
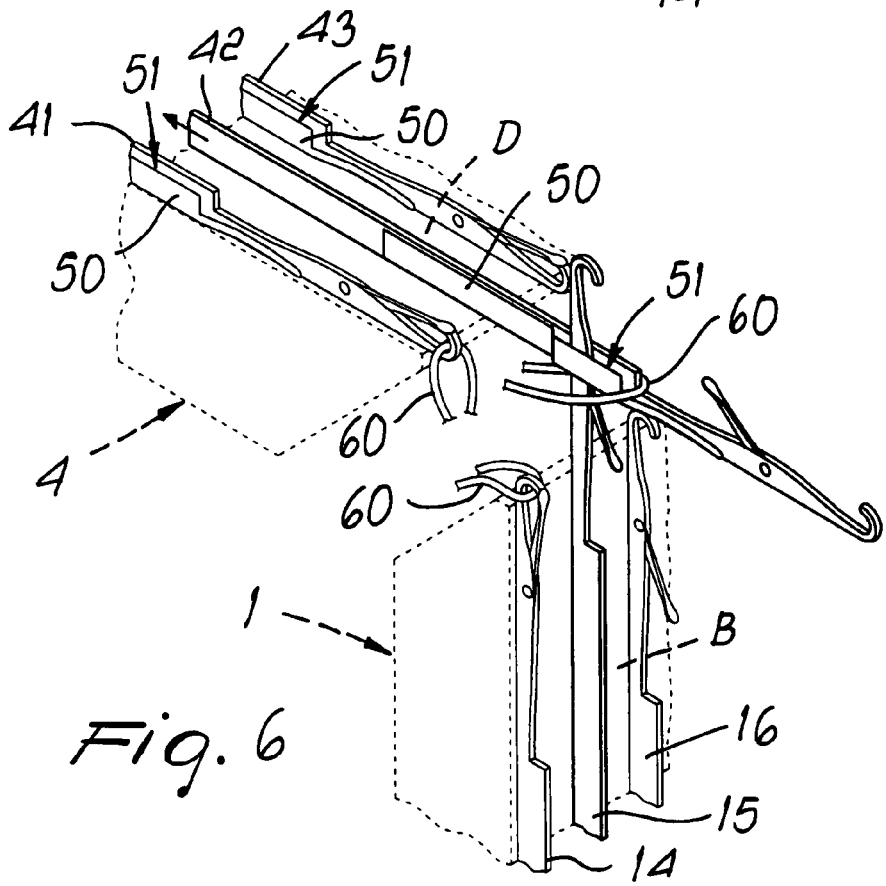
Figure 7:
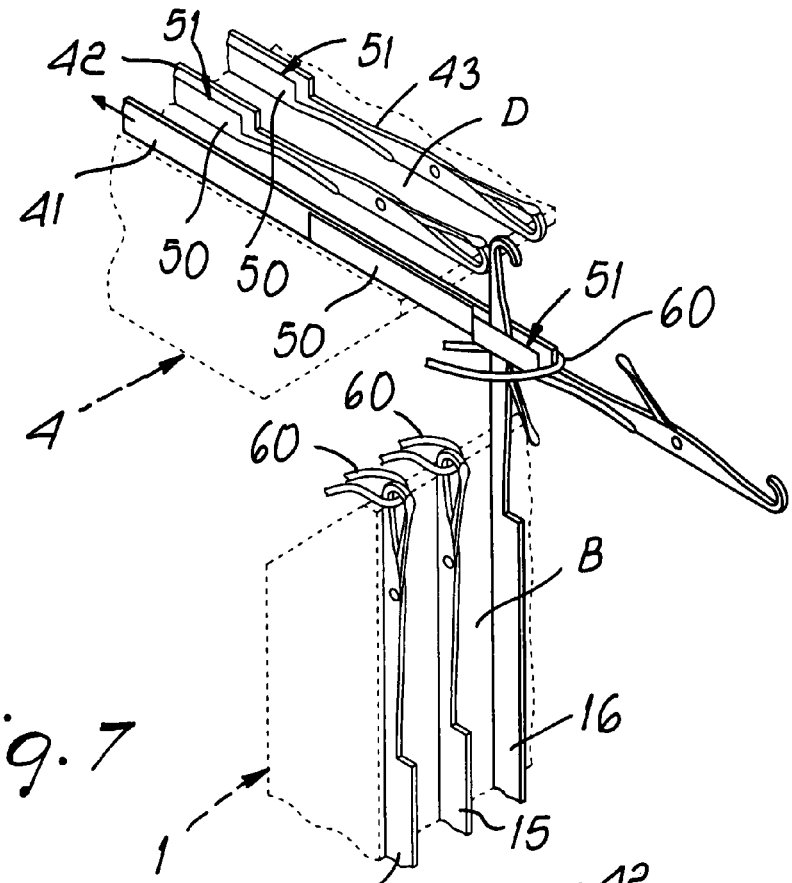
Figure 8:
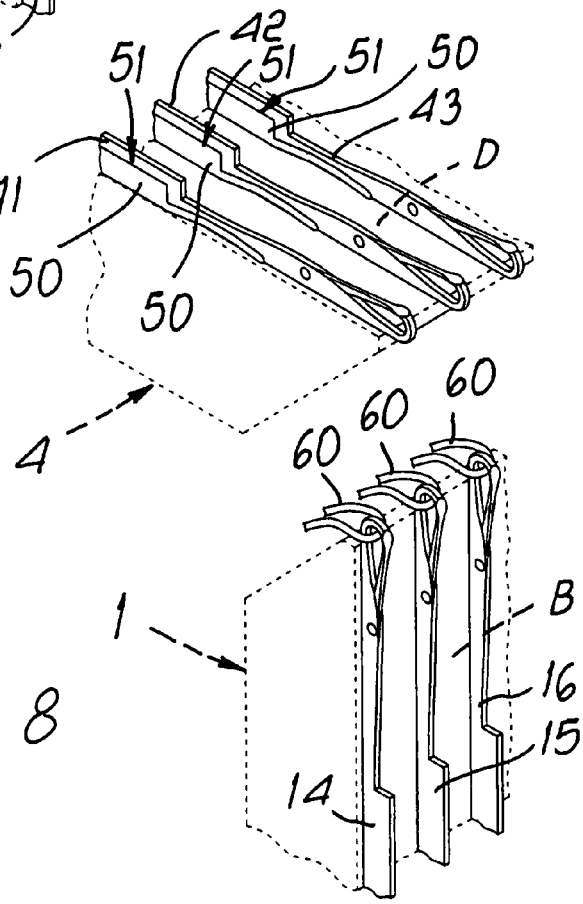

In the example shown in FIGS. 2 to 8, transfer from the needles of the dial 4 to the needles of the needle cylinder 1 is performed by gradually increasing the angular offset of the dial 4 with respect to the needle cylinder 1. In practice, with reference to FIGS. 2 to 8, first the loop of knitting 60 is released from the needle 43 of the dial 4 to the needle 14 of the needle cylinder 1, as shown in FIGS. 3 to 5, and then the offset of the dial 4 with respect to the needle cylinder 1 is increased and the loop of knitting 60 is released from the needle 42 of the dial 4 to the needle 15 of the needle cylinder 1, as shown in FIG. 6, and then the offset of the dial 4 with respect to the needle cylinder 1 is increased further and the loop of knitting 60 is released from the needle 41 of the dial 4 to the needle 16 of the needle cylinder 1, as shown in FIG. 7.

It should be noted that the transfer according to the invention, with reversal of the orientation of the row of knitting that is transferred, might be performed also by starting the release from the needle 41 of the dial 4 to the needle 16 of the needle cylinder 1 and by ending with the release from the needle 43 of the dial 4 to the needle 14 of the needle cylinder 1, and that the angular offset between the dial 4 and the needle cylinder 1 might be performed both clockwise and counterclockwise.

The transfer of the loops of knitting 60 from each needle of the dial 4 to the corresponding needle of the needle cylinder 1 is performed by moving the needle of the dial 4 into the extracted position, so as to position in each instance the loop of knitting 60 to be released so that it straddles the slot 52 formed by the elastic spring 51 on the side of the needle of the dial 4 and so as to align said slot 52 with the needle of the needle cylinder 1 that must receive the loop of knitting 60. The needle of the needle cylinder 1 is then inserted through the slot 52 and the needle of the dial 4 is then moved to the retracted position so as to release the loop of knitting 60 onto the needle of the needle cylinder 1, as shown in particular in FIGS. 3, 4 and 5.

The needles of the dial 4 that must release the loop of knitting 60, as well as the needles of the needle cylinder 1 that must receive the loop of knitting 60, are selected, by means of corresponding selection devices, of a known type as mentioned above, so as to perform in each instance the extraction of a needle of the dial 4 and then its retraction into the dial 4, as well as the lifting and subsequent lowering of the needle of the needle cylinder 1 that must receive the loop of knitting 60, before increasing or decreasing the offset of the dial 4 with respect to the needle cylinder 1 and then extract the contiguous needle of the dial 4. The movement for the extraction and retraction of the needles of the dial 4 and the movement for lifting and lowering the needles of the needle cylinder 1 can be obtained by actuating the needle cylinder 1 and the dial 4 with a continuous rotary motion about their axis 1*a* or by actuating them with an alternating rotary motion about said axis 1*a* with respect to the cam or cams of the dial 4 which actuate the extraction and retraction of the needles of the dial 4 and with respect to the cams which actuate the lifting and lowering of the needles of the needle cylinder 1.

It should be noted that the reversal of the orientation of the row of knitting that is transferred can be performed, instead of during the step for releasing the row of knitting to the second group of needles, during the step for engaging said row of knitting if said engagement step consists of a release of the row of knitting from the needles of the first group of needles to the engagement elements of the dial 4. In this case, the passage of the row of knitting from the needles of the first group of needles to the engagement elements of the dial 4 begins after the two angularly mutually closest or furthest ends of the sector D of the dial 4 and of the first sector A of the needle cylinder 1 have been made to face each other, and by performing the passage, in each instance, of a loop of knitting from a needle of the sector A to an engagement element of the sector D of the dial 4, gradually increasing or decreasing, between the passage of one loop of knitting and the passage of a contiguous loop of knitting, the angular offset of the dial 4 with respect to the needle cylinder 1 around its own axis 1*a* until the row of knitting is completely transferred from the needles of the first group of needles to the engagement elements of the dial 4.

The actuation of the needles of the first group of needles that must release the row of knitting and the actuation of the engagement elements of the dial 4 that must receive the row of knitting can be performed in a manner similar to what has been described above with reference to the release of the row of knitting from the dial to the second group of needles.

If the reversal of the orientation of the row of knitting being transferred is performed during the engagement step, the release step can be performed by means of a simple passage of the row of knitting from the engagement elements of the dial 4 to the needles of the second group of needles, without performing a gradual increase or decrease between the passage of a loop of knitting and the passage of the contiguous loop of knitting. Substantially, the release step can be performed in a manner similar to what has been described with reference to FIG. 1, with the difference that the passage of the row of knitting is performed from the dial 4 to the needle cylinder 1.

In any case, the transfer performed according to the invention achieves the reversal, during transfer, of the portion of knitting in one direction or in the opposite direction.

By means of the reversal of the orientation of the row of knitting of the first portion of knitting 2 during its transfer, it is possible to compensate for the rotation that the portion of knitting produced by the first group of needles undergoes as a consequence of the offset of the dial 4 with respect to the needle cylinder 1 or increase this rotation in order to achieve a twisting of the portion of knitting, depending on the effect that is to be obtained on the item of clothing, as will become better apparent hereinafter.

Merely by way of indication, FIGS. 9 to 12 illustrate a first use of the method according to the invention in joining two portions of knitting 2, 3 by transferring, by means of the needles arranged in a first sector D of the dial 4, the portion of knitting 2 produced by a first group of needles arranged in a first sector A of the needle cylinder 1 to a second group of needles, which are arranged in a second sector B of the needle cylinder 1 and have produced a second portion of knitting 3. In this case, the passage of the portion of knitting 2 from the needles of the first sector A to the needles of the second sector B of the needle cylinder 1 is performed by picking up the loops of knitting of the last row of knitting formed by the needles of the first sector A of the needle cylinder 1 and then offsetting, counterclockwise in the figures, the dial 4 with respect to the needle cylinder 1 and gradually increasing the offset during the release of the row of knitting to the needles of the second sector B.

Figure 9:
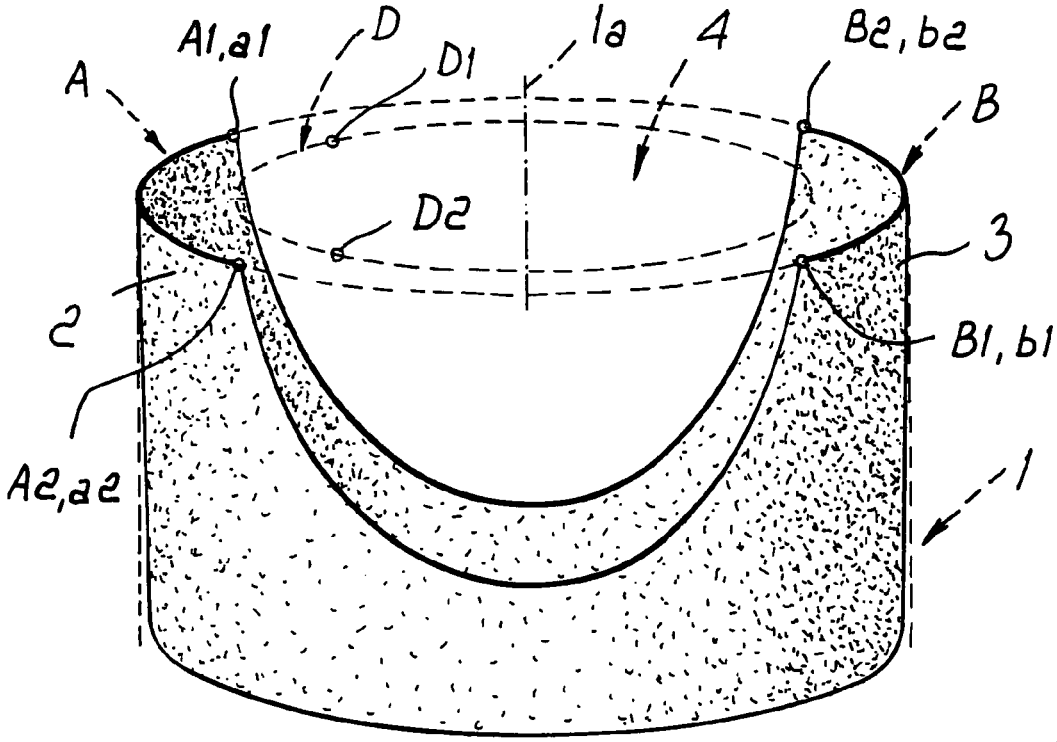
FIGS. 9 to 12 are schematic views of a first use of the method according to the invention in the production of a first knitted article.
Figure 10:
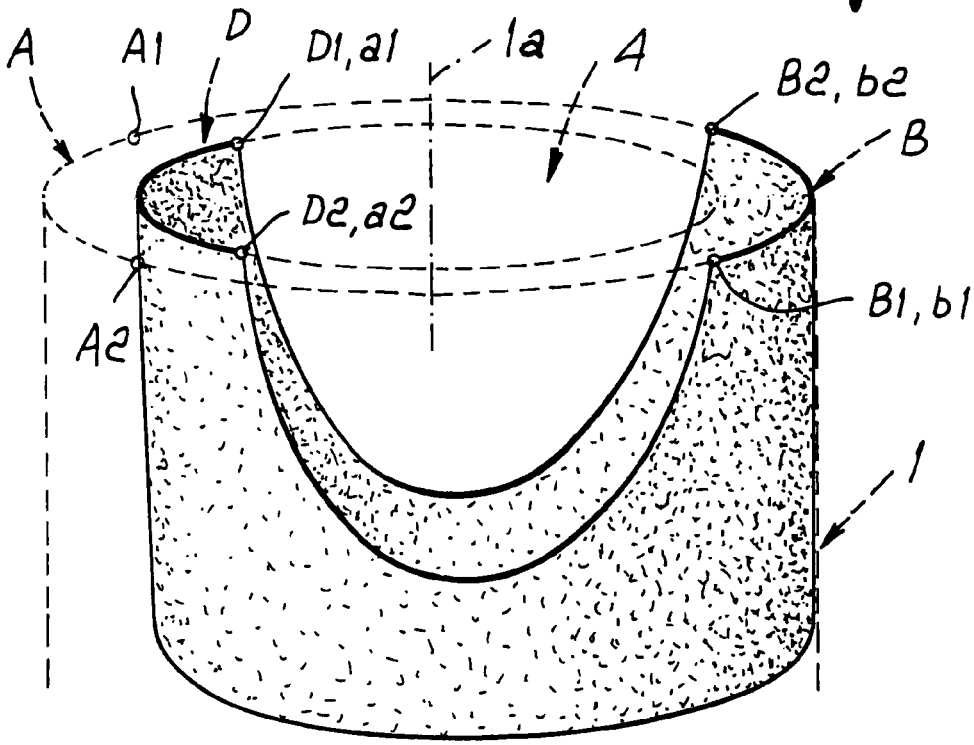
Figure 11:
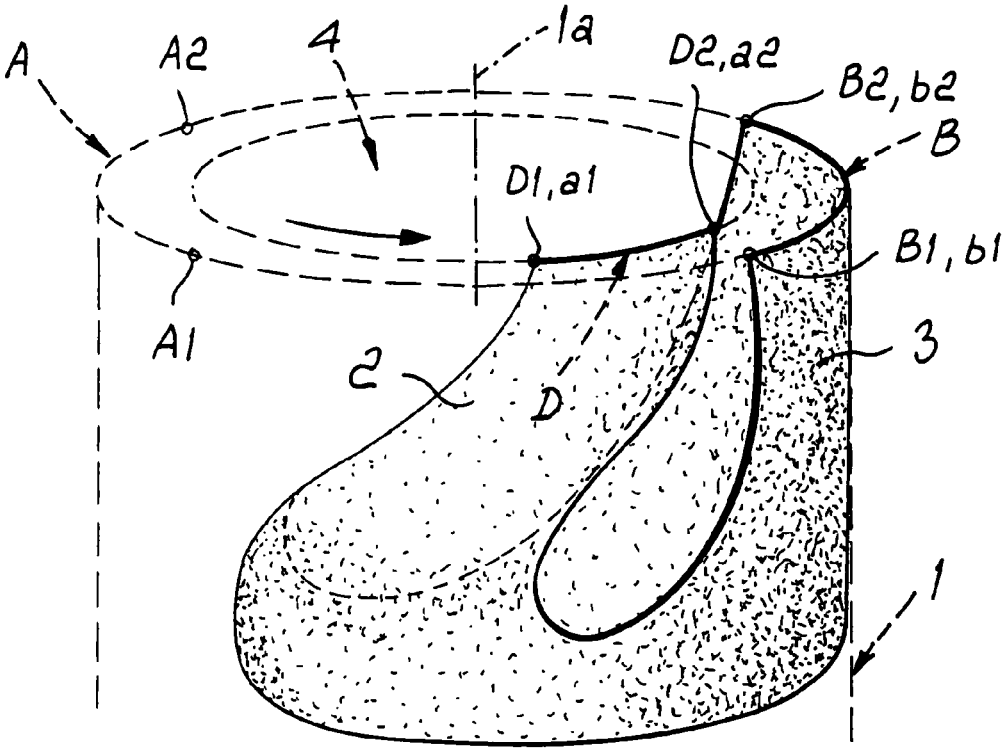
Figure 12:
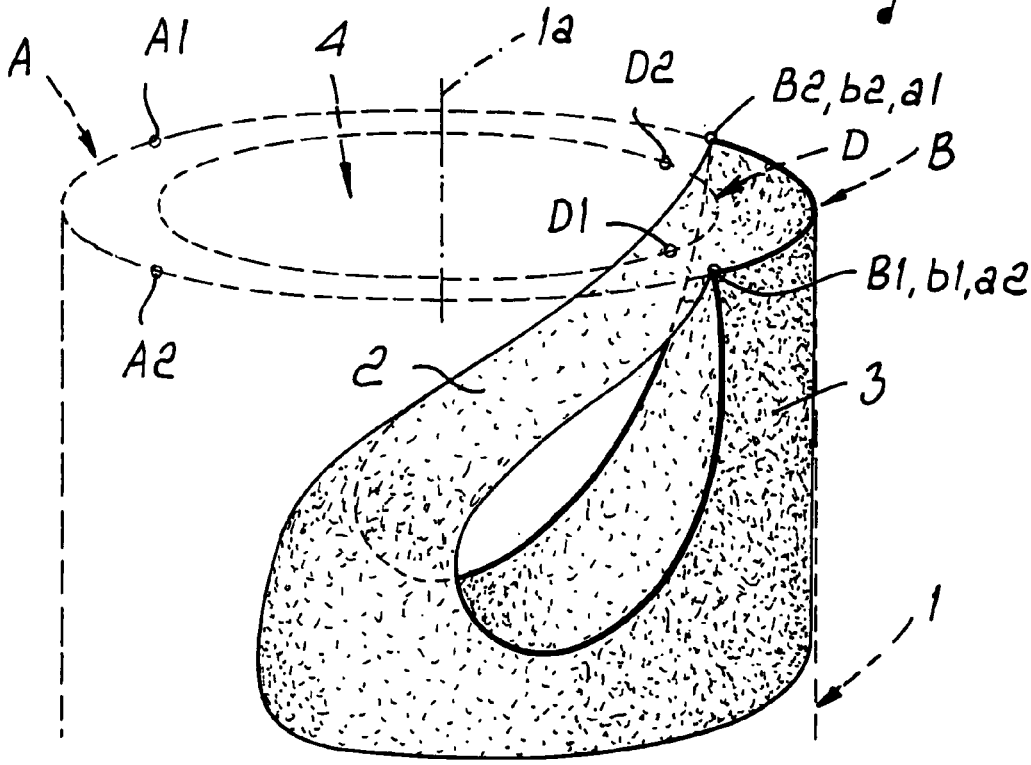
Figure 13:
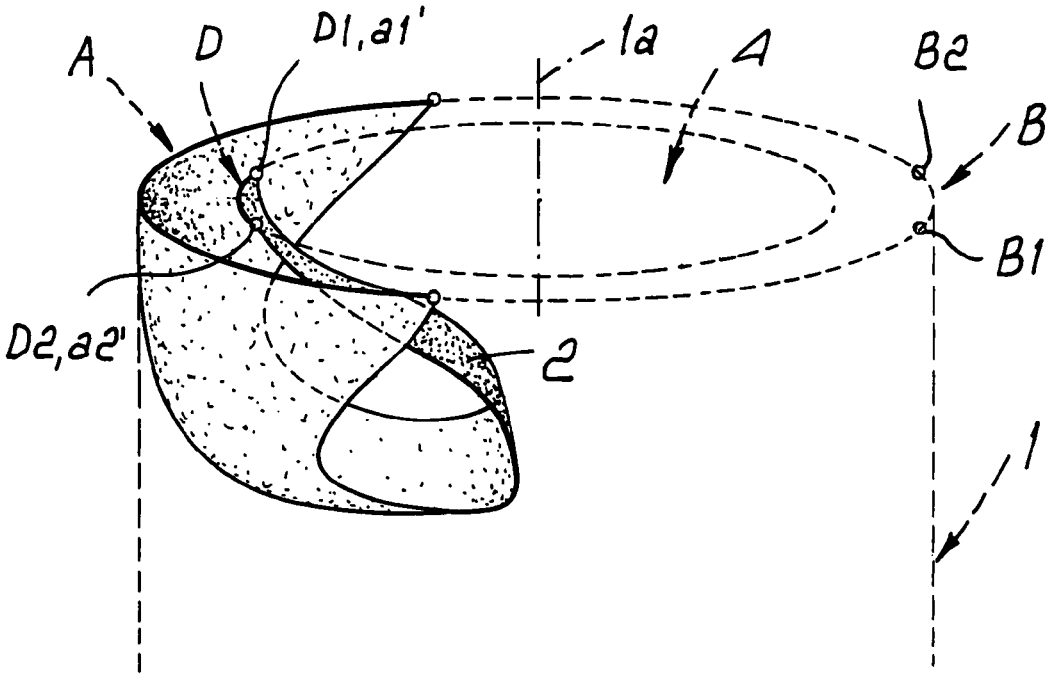
FIGS. 13 to 16 are schematic views of a second use of the method according to the invention in the production of a knitted article.

In practice, using the reference signs a1 and a2 to designate the ends of the last row of knitting of the first portion 2 produced by the needles arranged in the first sector A of the needle cylinder 1 which are located at the ends A1 and A2 of the first sector A of the needle cylinder 1, using the reference signs b1 and b2 to designate the ends of the last row of knitting of the second portion 3 produced by the needles arranged in the second sector B of the needle cylinder 1, which are located at the ends B1 and B2 of the second sector B of the needle cylinder 1, and using the reference signs D1 and D2 to designate the ends of the first sector D of the dial 4, first the last row of knitting of the first portion of knitting 2 is passed from the needles of the first sector A of the needle cylinder 1 to the needles of the first sector D of the dial 4 without reversing the orientation of the row of knitting, i.e., without an angular offset of the dial 4 with respect to the needle cylinder 1 during this passage. In this manner, the ends a1 and a2 of the last row of knitting of the first portion 2 pass respectively from the end A1 to the end D1 and from the end A2 to the end D2 (FIGS. 9 and 10). Then the last row of knitting of the first portion of knitting 2 is released from the needles of the first sector D of the dial 4 to the needles of the second sector B of the needle cylinder 1, reversing the orientation of the row of knitting, i.e., performing a gradual angular offset of the dial 4 with respect to the needle cylinder 1 during release. In this manner, the ends a2 and a1 of the last row of knitting of the first portion 2 pass respectively from the end D2 to the end B1, overlapping the end b 1, and from the end D1 to the end B2, overlapping the end b2 (FIGS. 11 and 12). At the end of the transfer, the two portions of knitting 2 and 3 are located on the needles of the second sector B of the needle cylinder 1, with their reverse sides facing each other, since the rotation of the first portion 2, produced by the angular offset of the dial 4 with respect to the needle cylinder 1, is canceled out by the rotation of the first portion 2 during its transfer to the needles of the sector B of the needle cylinder 1 produced by reversing the orientation of the transferred row of knitting. In this manner it is possible to achieve, after transfer, the joining of the portions of knitting 2 and 3 by producing one or more rows of knitting, with ladderproof or ladder-resistant structures, with the needles of the second sector B of the needle cylinder 1. This technique can be used, for example, to produce the seamless joining of the two flaps of the crotch of articles such as underpants or the like by starting the article in the belt, waist or hip region.

Figure 14:
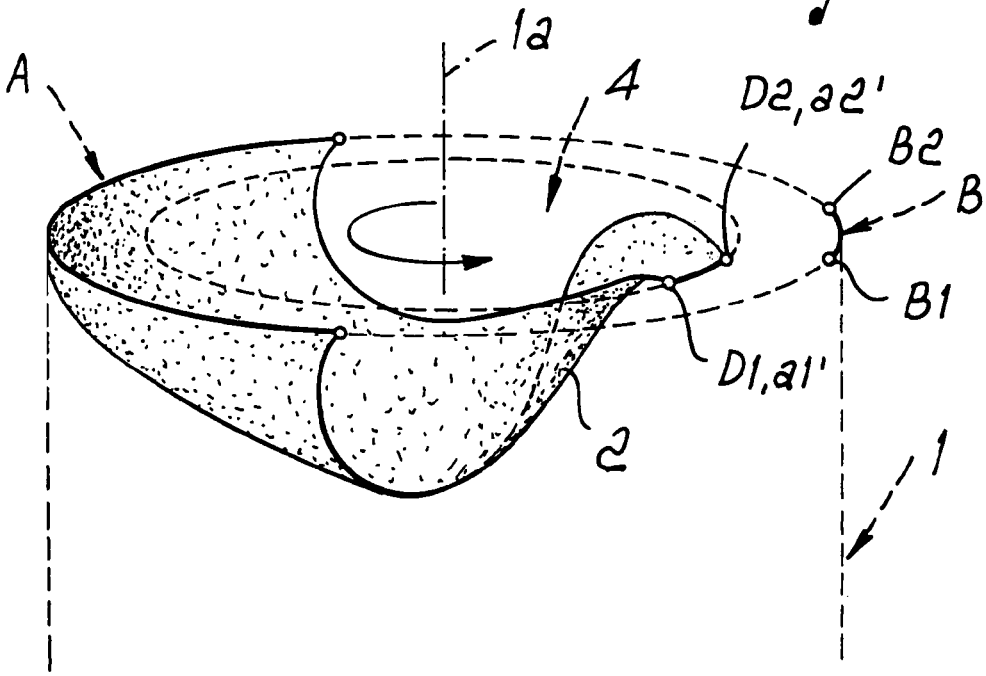
Figure 15:
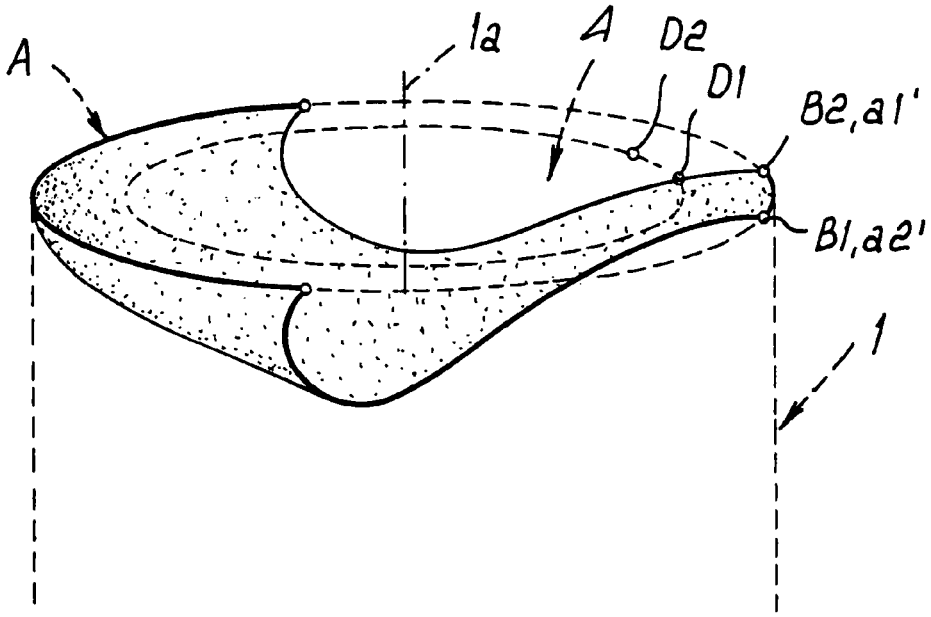
Figure 16:
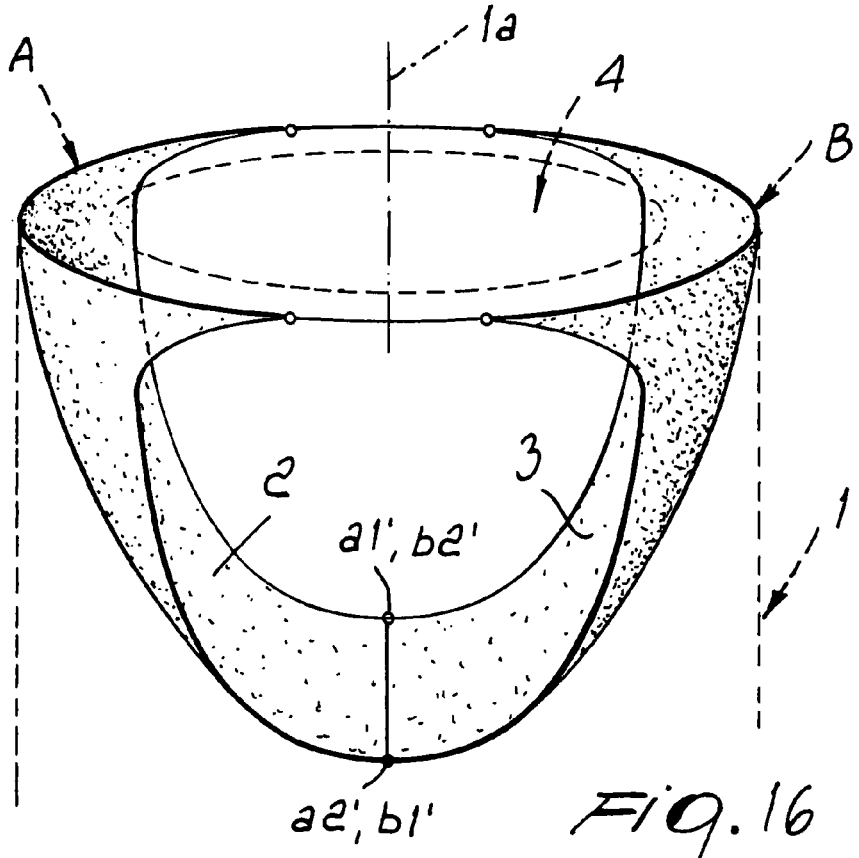

FIGS. 13 to 16 illustrate a second use of the method according to the invention in joining two portions of knitting 2, 3, performed by transferring, by means of the needles arranged in a first sector D of the dial 4, the first portion of knitting 2, retained by the needles of the dial 4 at the beginning of its forming and produced by a first group of needles arranged in a first sector A of the needle cylinder 1 (FIG. 13), to a second group of needles arranged in a second sector B of the needle cylinder 1. The release of the portion of knitting 2 from the needles of the first sector D of the dial 4 to the needles of the second sector B of the needle cylinder 1 is performed by offsetting, counterclockwise in the figures, the dial 4 with respect to the needle cylinder 1 and by gradually increasing the offset during the release. Using the reference signs D1 and D2 to designate the ends of the first sector of the dial 4 that have respectively retained the ends a1' and a2' of the first row of knitting formed by the needles arranged in the first sector A of the needle cylinder 1 and the reference signs B1 and B2 to designate the ends of the second sector B of the needle cylinder 1 that must receive the row of knitting previously retained by the needles of the sector D of the dial 4, the ends a2' and a1' of the row of knitting of the first portion 2 pass respectively from the end D2 to the end B1 and from the end D1 to the end B2 (FIGS. 14 and 15). At the end of the transfer, the portion of knitting 2 is arranged both on the needles of the first sector A of the needle cylinder 1 and on the needles of the second sector B of the needle cylinder 1, with its reverse side directed upwardly, since in this case also the rotation of the transferred portion of knitting 2 produced by the angular offset of the dial 4 with respect to the needle cylinder 1 is canceled out by the rotation of the portion of knitting 2 during its transfer, produced by means of the reversal of the orientation of the transferred row of knitting. In this manner, after transfer it is possible to produce a second portion of knitting 3, with an initial row of knitting with ends b1' and b2' which are joined respectively to the ends a2' and a1' of the transferred row of the first portion 2, with the needles of the second sector B of the needle cylinder 1 as an extension of the first portion 2 (FIG. 16). The needles arranged in the first sector A of the needle cylinder 1 may also be actuated together with the needles arranged in the second sector B of the needle cylinder 1 in order to complete the article. This technique can be used for example to join seamlessly the two flaps of the crotch of articles such as underpants or the like.

Figure 17:
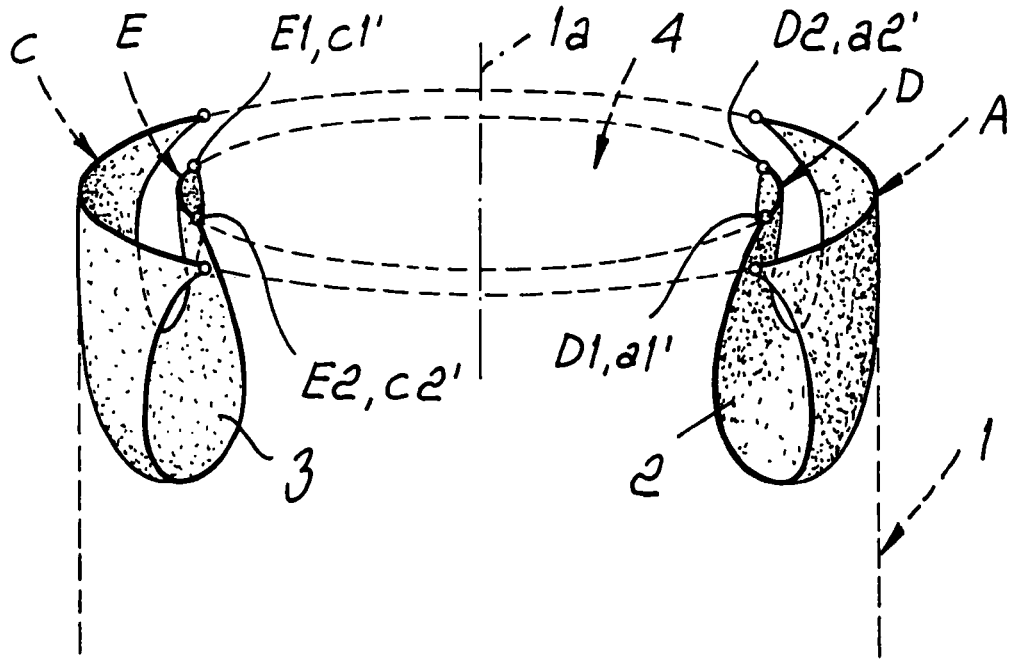
FIGS. 17 to 20 are schematic views of a third use of the method according to the invention in the production of a knitted article.

FIGS. 17 to 20 illustrate a third use of the method according to the invention in joining two portions of knitting 2 and 3, performed by transferring, by means of the needles arranged in a first sector D of the dial 4, the first portion of knitting 2, retained by the needles of the dial 4 at the beginning of its forming and produced by a first group of needles arranged in a first sector A of the needle cylinder 1, to a second group of needles arranged in a second sector B of the needle cylinder 1, onto which the second portion of knitting 3 knitted by a third group of needles arranged in a third sector C of the needle cylinder 1 has been transferred beforehand. The second portion of knitting 3, produced by the needles of the needle cylinder 1 arranged in the third sector C of the needle cylinder 1, is retained by the needles arranged in a second sector E of the dial 4 at the beginning of its forming (FIG. 17). The transfer of the second portion of knitting 3 from the needles of the second sector E of the dial 4 to the needles of the second sector B of the needle cylinder 1 is performed by turning the dial 4 counterclockwise with respect to the needle cylinder 1 and without reversing the orientation of the row of knitting being transferred, i.e., without increasing or decreasing the offset of the dial 4 with respect to the needle cylinder 1 during the passage of the loops of knitting from the dial 4 to the needle cylinder 1.

Figure 18:
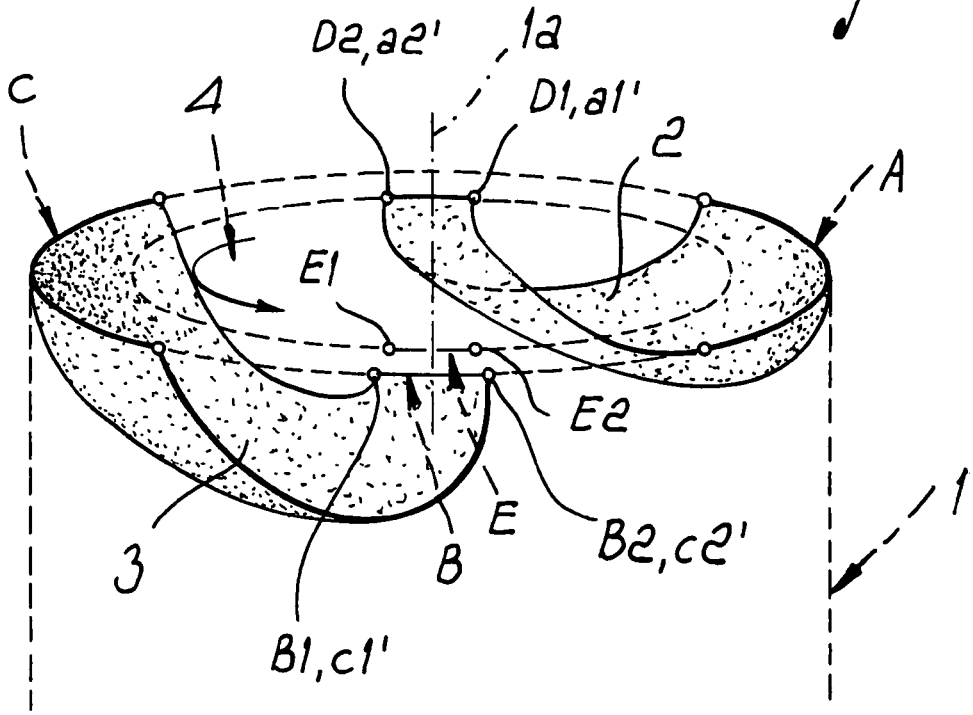

Using the reference signs B1, B2, D1, D2, E1, E2 to designate the ends of the sector of the needle cylinder 1 and of the sectors of the dial 4 that are involved in the transfer and a1', a2', c1' and c2' to designate the ends of the rows of knitting of the first portion of knitting 2 and of the second portion of knitting 3 retained by the sectors D and E of the dial 4, the ends c1', c2' of the row of knitting of the second portion of knitting 3 retained by the needles of the sector E of the dial 4 pass from E1 to B1 and from E2 to B2 (FIG. 18).

Figure 19:
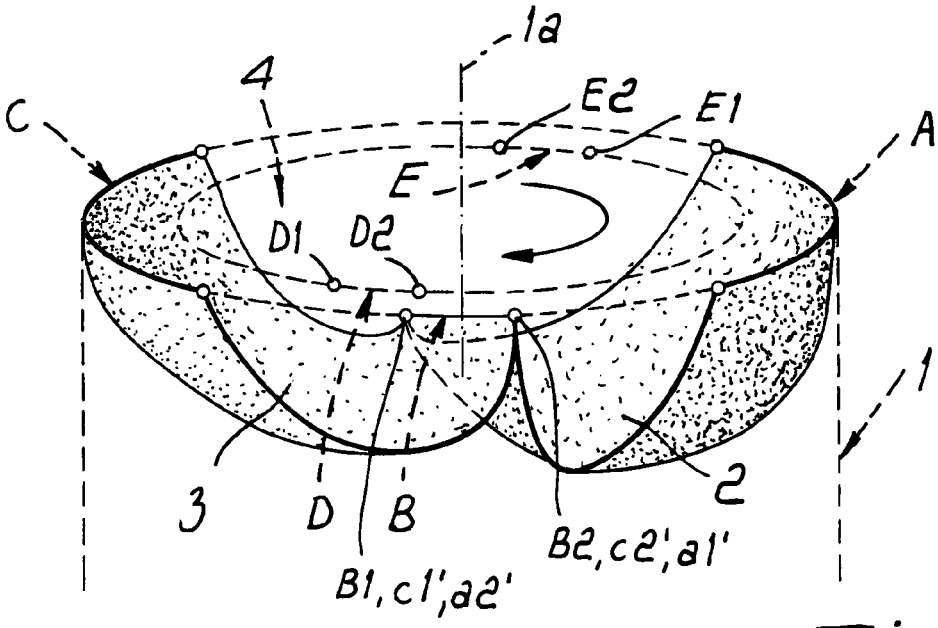
Figure 20:
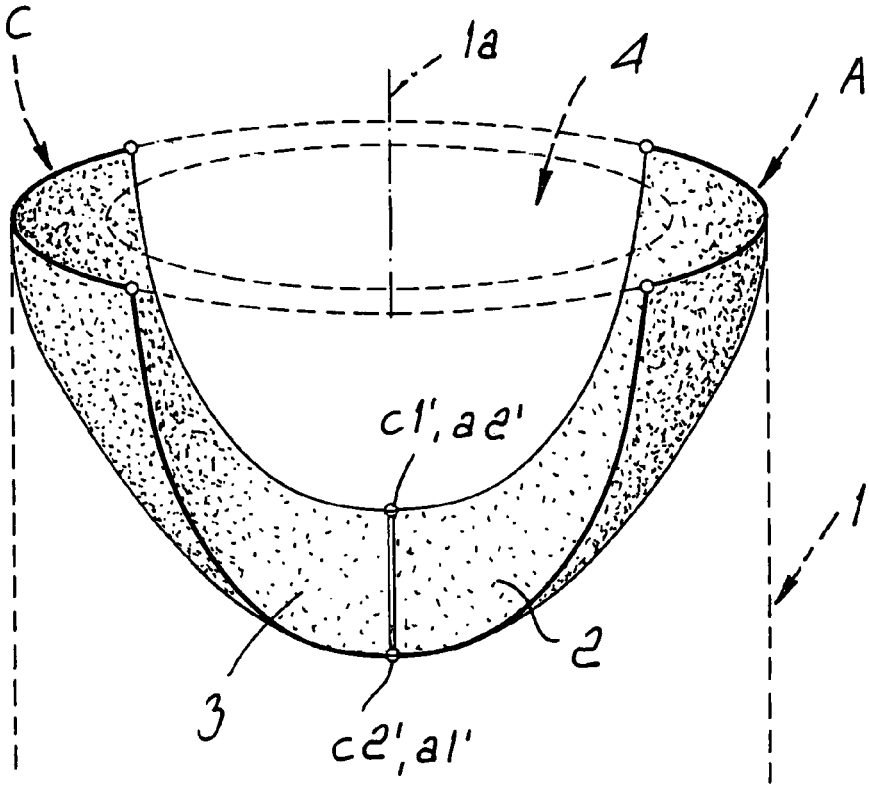

In this manner, the second portion of knitting 3 is provided on the needles of the second sector B of the needle cylinder 1 with its reverse side directed toward the outside of the needle cylinder 1. The passage of the first portion of knitting 2 from the needles of the first sector D of the dial 4 to the needles of the second sector B of the needle cylinder 1 is instead performed, according to the invention, by reversing the orientation of the row of knitting retained by the sector D, i.e., by offsetting, clockwise in the figures, the dial 4 with respect to the needle cylinder 1 and gradually increasing the offset during the release of the row of knitting from the sector D of the dial to the sector B of the needle cylinder 1. In practice, the transfer of the first portion 2 achieves the passage of the ends a1' and a2' of the row of knitting of the first portion of knitting 2 retained by the needles of the sector D of the dial 4 from D1 to B2 and from D2 to B1 (FIG. 19).

In this manner, the first portion of knitting 2 is located on the needles of the second sector B of the needle cylinder 1, oriented so that its reverse side is directed toward the axis 1*a* of the needle cylinder 1. The needles of the second sector B of the needle cylinder 1 are then actuated so as to produce one or more rows of knitting, with ladderproof or ladder-resistant structures, for joining the two portions of knitting 2, 3 before releasing the article, the production whereof can therefore be continued with the needles arranged in the first sector A and in the third sector C of the needle cylinder 1. This technique, too, can be used for example to provide the seamless joining of the two flaps of the crotch of articles such as underpants or the like.

The method for transferring portions of knitting according to the invention has been explained exclusively with reference to the transfer of one portion of knitting or of two portions of knitting to be joined together, but can be used to perform, directly on the production machine, the joining of a plurality of pairs of portions of knitting, for example in order to join straps of body suits or bras without seams.

Moreover, in the illustrated embodiments the method according to the invention has been explained under the assumption of seeking to eliminate the twisting of the portion of knitting that is transferred, but the variation of the orientation of the transferred portion of knitting that can be obtained with the method according to the invention can be used in order to increase this twisting if required for aesthetic purposes or other purposes.

For the sake of greater simplicity, the method according to the invention in its use to join two portions of knitting produced by needles arranged in two different sectors of the needle cylinder has been described under the assumption that the two rows of knitting of the two portions of knitting that are joined have the same extension, but the joining of the two portions of knitting might also be performed between two rows which have mutually different dimensions, involving in the joining only a part of the longest row of knitting.

In practice it has been found that the method according to the invention fully achieves the intended aim, since by allowing to maintain or vary the orientation of the portion of knitting during transfer according to the requirements, it allows to perform, directly on the circular hosiery knitting machine with two beds or the like used to produce an article, the joining of portions of knitting produced by groups of needles which are located in sectors of a bed which are mutually angularly spaced around the axis of the bed, or more generally to perform particular processes which require the transfer of portions of knitting from the needles that produced them to other needles of a bed.

The method thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2004A002495 from which this application claims priority are incorporated herein by reference.

The invention claimed is:

1. A method for transferring portions of knitting produced by a group of needles to another group of needles of a bed in circular hosiery knitting machines with two beds, which comprise two mutually coaxial and facing beds, respectively a first bed provided with needles which can be actuated to produce knitting and a second bed provided with engagement elements, which can be actuated in order to retain or pick up loops of knitting formed by the needles of the first bed or to release loops of knitting, retained or picked up previously, to the needles of the first bed, the method comprising:

a step, performed by means of the engagement elements arranged in a first sector of the second bed, for engaging a row of knitting formed by a first group of needles arranged in a first sector of the first bed;

a step for the angular offset of the second bed with respect to the first bed around the axis of the first bed, in order to move said first sector of the second bed closer to a second sector of the first bed which is angularly spaced from said first sector of the first bed around the axis of the first bed and supports a second group of needles;

a step for releasing the row of knitting previously engaged by said engagement elements from the engagement elements arranged in said first sector of the second bed to said second group of needles arranged in said second sector of the first bed; and reversing the orientation of the row of knitting affected by the transfer during said engagement step or during said release step.

2. The method according to claim 1, wherein the step for reversal of the orientation of the row of knitting affected by the transfer is performed during said release step, said release step beginning after the angularly mutually closest or furthest ends of the first sector of the second bed and of the second sector of the first bed have been made to face each other, and being performed by means of the passage, in each instance, of a loop of knitting from the engagement elements of said first sector of the second bed to a needle of said second group of needles, gradually increasing or decreasing, between the passage of one loop of knitting and the passage of a loop of knitting contiguous to said one loop of knitting, the angular offset of the second bed with respect to the first bed, until the transfer of the row of knitting from the engagement elements arranged in said first sector of the second bed to the needles of said second group of needles is completed.

3. The method according to claim 1, wherein said engagement step is performed by means of the passage of a row of knitting from said first group of needles to the engagement elements ranged in said first sector of the second bed.

4. The method according to claim 1, wherein the step for reversal of the orientation of the row of knitting affected by the transfer is performed during said engagement step, said engagement step beginning after the angularly mutually closest or furthest ends of the first sector of the second bed and of the first sector of the first bed have been made to face each other and being performed by way of the passage, in each instance, of a loop of knitting from a needle of said first group of needles to an engagement element arranged in said first sector of the second bed, gradually increasing or decreasing, between the passage of one loop of knitting and the passage of a loop of knitting contiguous to said one loop of knitting, the angular offset of the second bed with respect to the first bed, until the transfer of the row of knitting from said first group of needles to the engagement elements arranged in said first sector of the second bed is completed.

5. A circular hosiery knitting machine for performing the method set forth in claim 1, comprising:

a needle cylinder, which can be actuated with a rotary motion about its own axis, which is arranged vertically;

a dial, which is arranged above and coaxially with respect to the needle cylinder;

knitting engagement elements, which are arranged in said dial and can be actuated in order to retain or pick up loops of knitting formed by the needles of the needle cylinder or release loops of knitting, previously retained or picked up, to the needles of the needle cylinder;

a first electric motor for actuating the needle cylinder with a rotary motion about its axis;

a second electric motor for actuating the dial with a rotary motion about its axis;

a system for electronic control of the actuation of said electric motors for a rigidly coupled actuation of said needle cylinder and of said dial with a rotary motion about the common axis or for angular offset of said dial with respect to said needle cylinder about the common axis.

* * * * *